US006453590B1

(12) United States Patent
Burke

(10) Patent No.: US 6,453,590 B1
(45) Date of Patent: Sep. 24, 2002

(54) PORTABLE EMBLEM

(76) Inventor: Edward Allen Burke, #13 Trillium La., R.R. #1 Utopia, Utopia On. (CA), L0M 1T0

( * ) Notice: Subject to any disclaimer, the term of this patent is extended or adjusted under 35 U.S.C. 154(b) by 0 days.

(21) Appl. No.: 09/458,179

(22) Filed: Nov. 19, 1999

(51) Int. Cl.[7] ..... G09F 17/00; G09F 1/08

(52) U.S. Cl. ..... 40/603; 40/538; 40/607; 248/910

(58) Field of Search ..... 40/538, 540, 603, 40/604, 606, 607; 248/122.1, 229.12, 910

(56) References Cited

U.S. PATENT DOCUMENTS 751,832 A * 2/1904 Cahn et al. ..... 40/606
3,922,998 A * 12/1975 May ..... 40/606 X
4,700,498 A * 10/1987 Perutz et al. ..... 40/606 X
4,875,302 A * 10/1989 Noffsinger ..... 40/606 X
4,885,858 A * 12/1989 Strom ..... 40/538
4,922,264 A * 5/1990 Fitzgerald et al. ..... 248/910 X
4,959,916 A * 10/1990 Cochrane ..... 40/603
5,555,659 A * 9/1996 Hade ..... 40/604
5,685,511 A * 11/1997 Ghany et al. ..... 40/604 X
6,012,688 A * 1/2000 LaMotte ..... 40/603 X

FOREIGN PATENT DOCUMENTS

BE 529802 * 7/1954 ..... 40/603
CH 440051 * 12/1967 ..... 40/603

* cited by examiner

*Primary Examiner*—Brian K. Green
(74) *Attorney, Agent, or Firm*—D. W. Eggins

(57) ABSTRACT

Lightweight advertising emblems that are readily knocked down into compact packages are mounted upon light standards or upon free-standing masts which use bases that incorporate local ballasting agents such as paving stones, gravel, sand, stones or water. The emblems have a display surface which may be planar, or may be wrapped to form a three-dimensional object, such as a giant sized paper drinking cup, complete with straw, an olympic style torch or other representation. The display surface is preferably of knitted material such as a polyester fabric, that may be printed upon by a silk-screen process, and is highly resistant to creasing. In the case of planar, banner-like displays, the mounting may include a rotary bearing, to permit weathervaning of the banner, for minimum wind resistance and dynamic display.

10 Claims, 2 Drawing Sheets

29
10
48
22
20
16
24
18
50
60
52
54
56
58
53
60
66
68
56
37
28
37
14
14
12
26
66'
70
68
11
72
COLA 47
46
44
12
30
44
32
45
36
38
32
36
42
44
34
44

74
76

30
36
14
14
46
38
36
32
14
14

PORTABLE EMBLEM

BACKGROUND OF THE INVENTION

1. Field of the Invention

This invention is directed to a portable emblem, and in particular to a visually prominent advertising emblem in readily assembled, knock-down format suitable for light-weight pre-packaging.

2. Description of the Prior Art

Modern commercial practice relies heavily upon the presentation of trademarks and other attention-riveting representative symbols before the general public. For example, many such symbols comprise inflated balloon forms that are tethered above an enterprise, as an attention-getting device. Other symbols may be in the form of signs, even billboards, erected upon the roofs of buildings, for the same purpose. Many of these prior-art emblems have significant drawbacks, such as in the case of balloons the requirement of providing a compressor or other inflation device, and an energy source to drive the compressor. In the case of hoarding or billboards, these require either an extensive base and free-standing supporting frame, or the provision of guy-wires and their associated anchors, for roof-top locations. In addition to the prime cost of the emblem and its supporting ancilliaries, the prior art emblems mostly are also expensive to transport, and their location and erection is labour-intensive, and therefor costly. While on a one-off basis these factors may appear somewhat insignificant, on a national basis, for a prominent business, the cumulative costs can be significant.

The present invention provides a visually prominent display emblem having a tensioned emblem surface; first mounting attachment means for securing an upper portion of the emblem; second mounting attachment means for securing a lower portion of emblem; and tensioning means to tension the emblem surface between the first and the second attachment means, to maintain the emblem surface in a substantially unwrinkled condition.

The aforesaid emblem is pole mounted, at least one of the mounting attachment means being mounted upon the pole.

The display emblem may be mounted upon a portable stand,wherein the pole is detachably mounted upon the stand.

The display emblem may be mounted upon a fixed standard, such as a lamp standard.

The display emblem tensioned emblem surface may be an imprinted cloth surface, preferably a knitted fabric that is resistant to creasing.

The display emblem may be a three-dimensional, enlarged simulation of an article, such as a paper drinking cup.

Another display emblem could be a torch, of the olympic type. The display emblem may be used in combination with a cantilevered support mast, the mast being mounted upon a portable base, the base incorporating separable ballast, to provide a light-weight base structure with enhanced transportability.

The base structure may consist of a framework having separable members for assembly with paving slabs into a substantially rigid unitary ballasted assembly, having a stub mast projecting upwardly therefrom to receive the mast in mounted relation thereon.

The base structure may comprise a light-weight plastic container having a mast receptacle therein, to receive the mast in supported relation therewith, the container having access and capacity for the insertion of locally available ballast material therein.

The base structure framework may have a first longitudinal member, two separate side members, each member including at least one underlying transverse plate, a unifying plate overlying the members, in bolted relation therewith, and closure members removably secured to the outer end of each the members, in use to constrain adjoining paving slabs in unitary, rigid relation with the framework.

The present invention thus provides a visually prominent, three-dimensional display emblem of light-weight modular components that are readily manufactured, packaged, transported and assembled. In the case of a free-standing embodiment the subject emblem has base components for use with locally available ballast, by which the emblem display is anchored. The base components may comprise frame members that assemble in conjunction with a number of standard patio paving slabs, upon which a mast portion of the display emblem is erected in cantilevered, free-standing relation. The paving slabs in combination with the assembled frame members constitute a heavy, rigid base of predetermined lateral extent, to stabilize the display emblem against overturning. The modular frame members are of comparatively short length, to facilitate convenient, low-cost packaging, while being readily assembled in constraining relation with the locally procured ballasting slabs.

In another embodiment, the base of the emblem display may comprise a tub-like container, preferably of lightweight plastic, through which a mast portion of the display may extend, the container being filled with a suitable, locally available ballasting material such as sand, gravel, water or stones. The container tub preferably has a central passage, to enable threading of the display mast portion upwardly therethrough, such that the addition of ballast then effectively anchors the display against displacement and overturning under normal wind forces.

The display emblem per se may comprise a form of banner. Such a banner may be of flexible material, suited to printing upon, such as by the silk-screen process. Use of a knitted polyester fabric provides multi-directional stretch to the wall of the emblem, and substantially precludes the formation of creases that could otherwise initiate tearing.

In one embodiment, the emblem consists of a printed banner wrapped as an inverted, truncated cone in the presentation as of a large paper drinking cup, having a top rim and a bottom ring.

The bottom ring is preferably secured to the display base, and the top rim in the form of a stiff ring, is secured in spaced relation from the mast portion of the display, by way of an axially slidable spacing spider.

The spacing spider may have a central boss, with a number of radial spokes engaging the rim ring. The boss of the spider is removably secured to the mast portion of the display by a detent that engages a spring-loaded button located a t a predetermined location within the mast. The location of the button enables the spacing spider to apply tension to the banner portion of the emblem, by way of its resilient spokes, such that the emblem appears as a giant-sized paper drinking cup, having a desired logo, name or other printed decoration upon the surface thereof In the case of a drinking cup emblem, the subject spider may be eccentrically inclined, with a corresponding inclination of the bottom ring, giving a representation of a paper cup inclined at a "drinking" angle.

A short length of plastic tube may be mounted as a part of the display, being suitably axially striped, as a realistic representation of a drinking straw protruding above the cup. The subject display emblem may be of a form other than a drinking cup, such as a substantially planar banner, which may be rotatably secured to the mast by way of a substantially horizontal swinging arm, mounted upon a simple rotational bearing, to minimize the application of wind forces against the mast. Another three dimensional emblem may be in the tubular form of a torch, such as a stylized olympic torch. Alternative three-dimensional embodiments may include beverage cans, tetra-pak (T.M.) cartons, cereal boxes and the like. It will be understood that the following disclosure shows selected embodiments by way of example, such that one skilled in the art can readily adopt the present invention by way of other embodiments, lying within the intended scope of the present claims.

BRIEF DESCRIPTION OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figures 1, 4, 5:
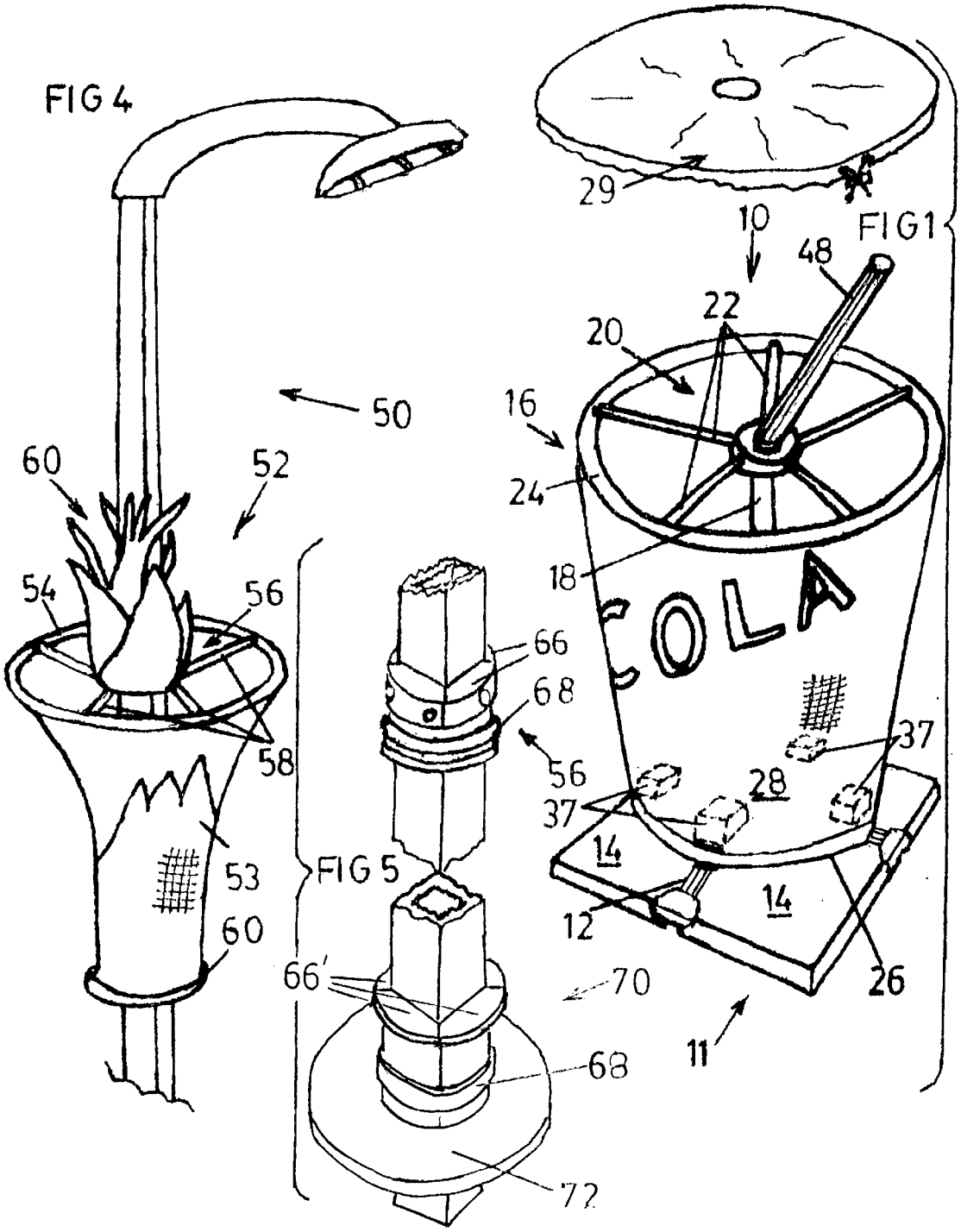
FIG. 1 is a top perspective view of a "cup" embodiment of the present invention.
FIG. 4 is a side view, in partial section, of a "cup" embodiment mounted upon a lampstandard.
FIG. 5 is a perspective view of portions of the mounting attachments of the FIG. 4 embodiment, and, FIG. 6 is a view from above of a ballast container having a mast receptacle therein.

Referring first to FIG. 1 a free-standing emblem display 10 has a base 11, consisting of a composite cruciform frame 12, portions of which appear, together with four paving slabs 14, of which the fourth is concealed by the cup-emblem 16 . The frame 12 serves to hold the slabs 14 in securely assembled relation.

A mast 18, cantilevered upwardly from the base 11, carries a spider assembly 20 adjacent its upper end. The spider assembly 20 has a series of tension rods 22 extending radially outwardly to engage in axially positioning relation a stiff ring 24 that constitutes the top rim of the cup-emblem 16.

The bottom rim portion 26 of the cup-emblem 16 is internally clamped to the frame 12, by way of concealed clamps 37, shown symbolically, in phantom, to hold the cups-emblem 16 in secured relation upon the base 11. The resilient rods 22 apply upward tensioning force to the rim ring 24, to tension the display 10 such that the fabric wall 28 of the emblem is held in tensioned relation. Use of a knitted polyester fabric provides multi-directional stretch to the wall 28 of the cup-emblem 16, and substantially precludes the formation of creases that could otherwise initiate tearing.

The bottom rim portion 26 of the cup-emblem 16 is internally clamped to the frame 12, to hold the cup-emblem 16 in secured relation upon the base 11 by way of concealed clamps such as clamps 36 (see below).

The fabric wall 28 of the cup-emblem 16 is imprinted with a desired message, trademark or the like A simulated lid 29 may be solid, or of flexible plastic with a draw string in the rim to secure it to the cup emblem 16, where it conceals the spider assembly 20.

Figure 2:
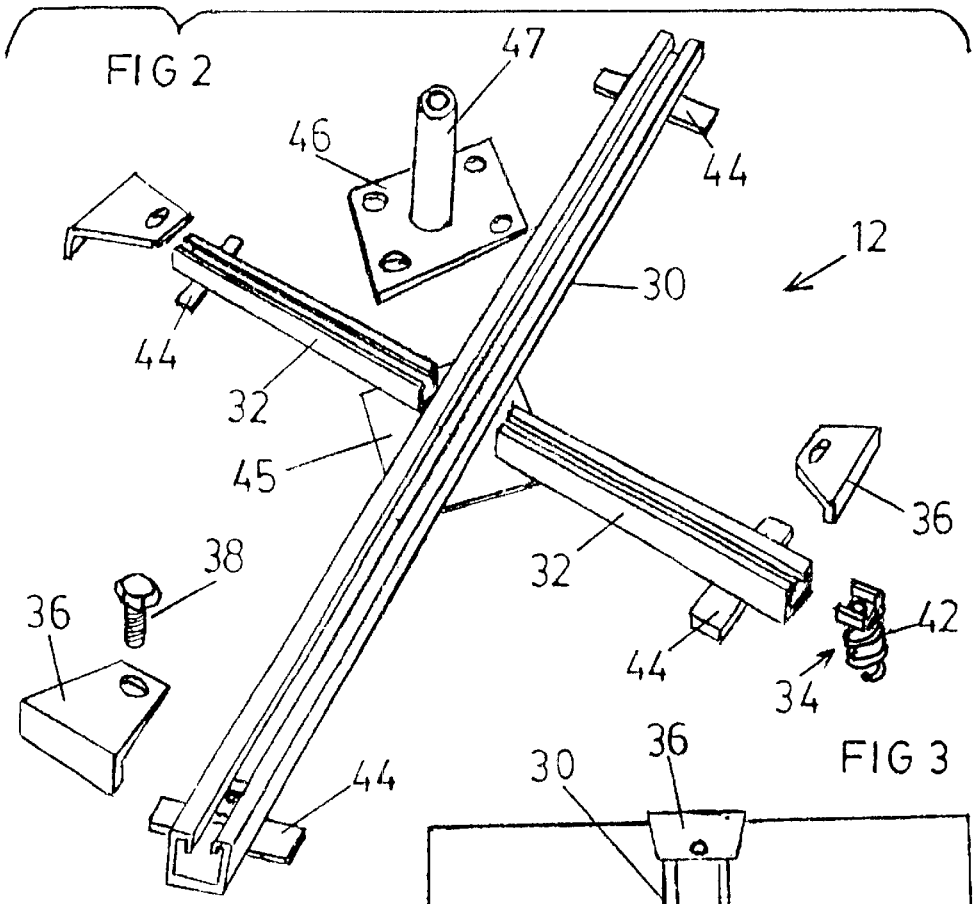
FIG. 2 is an exploded perspective view of component portions of a base frame of the sue displays.
Figure 3:
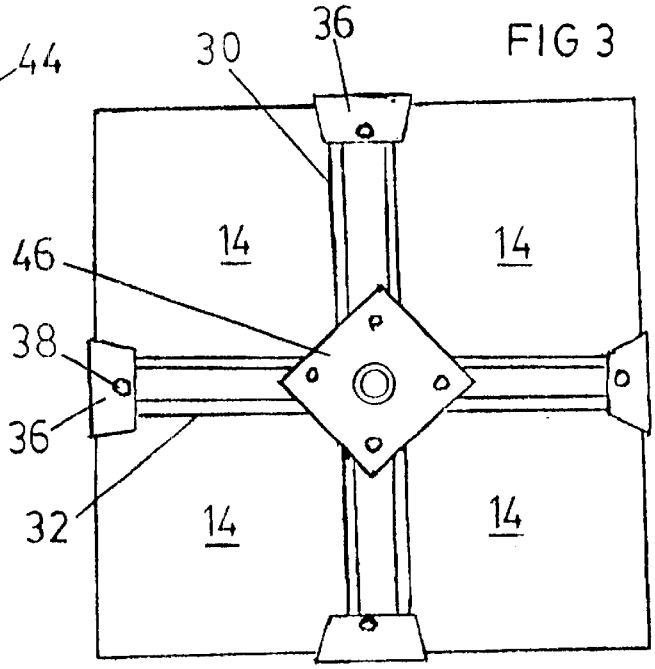
FIG. 3 is a plan view of the base frame in assembled relation with a set of paving slabs.

Turning to FIGS. 2 and 3, the frame 12 has a main member 30 and two side arms 32. These three members are of channel section, to receive slide-nuts 34 in entered slidable relation within the section. The outer ends of the members 30, 32 each has a closure bracket 36 secured in place by a bolt 38 engaging a slide nut 34, located within the respective channel section. Each slide nut 34 has a positioning spring 42 coiled beneath it and holding the grooved upper surface of the slide nut 34 pushed upwardly against the downturned inner edges of the respective channel section. The frame members 30, 32 each has laterally extending foot-pads 44 secured to their respective undersides and located adjacent their outer ends, upon which rest the slabs 14. A square plate 45 secured beneath the main member 30 supports the inner comers of the four slabs 14.

Similarly, by use of four bolts 38 and four slide nuts 34, the bottom rim portion 26 of the cup emblem 16 is clamped down to the frame 12 by way of four outward facing clamps such as clamps 36 concealed within the cup emblem 26. Tension springs or shock cords may also be used to secure the rim 26 to the frame or tub base.

Assembly of the base 11, by assembling elements of the frame 12, and positioning the slabs 14, followed by installation of the closure brackets 36 provides a rigid, ballasted structure, to receive the mast 18 in slidably mounted relation upon the stub-mast 47.

A plastic tube 48 (FIG. 1) may be mounted upon the top end of the mast 18, in inclined relation as the representation of a drinking straw.

Referring to FIG. 4, a lamp standard 50 has a three-dimensional emblem 52 in the form of an olympic style torch mounted upon the standard 50 in spaced relation from the ground. The emblem 52 has a formed peripheral cover 53 similar to the above described fabric wall 28 of the cup emblem. The emblem 52 has a stiff upper peripheral ring 54, supported by way of a spider assembly 56 with resilient tension rods 58 that exert an upward resilient loading against the ring 54.

The spider assembly 56 supports a flame representation 60 that surrounds the standard 50. A bottom handle portion of the emblem 52 has an enclosing disc 62, to which the fabric cover 53 is attached.

Referring to FIG. 5, the upper spider assembly 56 comprises four segments 66 secured to the sides of the standard 50 by way of a clamping ring 68. The clamping ring 68 may comprise a metal-band clamp of the type known as a Jubilee (T.M.) clamp. Other forms of clamp, such as a hook and loop ( T.M."Velcro") band may prove feasible.

A lower assembly 70 in inverted relation comprises four segments 66' secured by a clamping ring 68 located at the top of the assembly 70, and serves to maintain a bottom tensioning disc 72 of the emblem 52 in predetermined spaced relation from the upper spider assembly 56, so as to maintain the cover 53 in a tensioned condition, by way of the tension rods 58.

Figure 6:
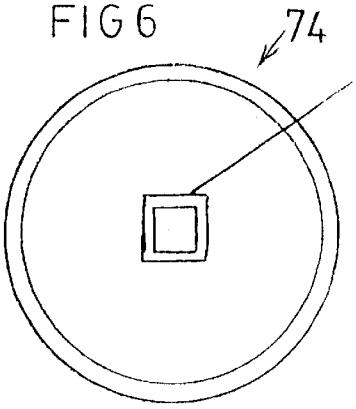

Referring to FIG. 6, a tub 74 has a receptacle 76, through which a mast portion of the display may extend. The container 74 may be filled with ballasting material such as sand, gravel, water or stones, to anchor the display against displacement or overturning under normal wind forces.

In the case of a simple, flag-like planar banner, use of the above-disclosed support system enables the banner to be suspended in a tensioned condition. The use of a simple bearing, preferably at the top support, enables the banner to readily weather-vane, such that the wind forces acting upon the system are minimized and the banner display is dynamic, while avoiding the severe drawback of the banner enwrapping its supporting mast or standard.

What is claimed is:

1. In combination, a single cantilevered support mast supported by a separable portable, ballasted base structure, and a visually prominent elevated, substantially unbraced, hollow out-door display emblem having a tensioned display surface; first mounting attachment means projecting from said support mast in cantilevered relation at a predetermined raised location securing an upper portion of said emblem in an outwardly extended state at said predetermined raised location; second mounting attachment means for securing a lower portion of said emblem at a predetermined second lower location; said support mast extending upwardly within said emblem between said first and said second locations in sole supporting relation therebetween, wherein said first mounting attachment means provides an upwardly resilient supporting force to said emblem, to maintain said emblem display surface in a tensioned, substantially unwrinkled extended condition, as a semi-permanent display.

2. The display emblem as set forth in claim 1, wherein said tensioned emblem surface is an imprinted cloth surface.

3. The display emblem as set forth in claim 2, wherein said cloth surface is a knitted fabric that is resistant to creasing.

4. The display emblem as set forth in claim 3, wherein said cloth surface knitted fabric is polypropylene.

5. The display emblem as set forth in claim 1, wherein said emblem is a three-dimensional, enlarged simulation of an article.

6. The display emblem as set forth in claim 5, wherein said article is a drinking cup having said tensioned display surface as an inverted, truncated cone.

7. The combination as set forth in claim 1, said base structure incorporating separable ballast, to provide a light-weight base structure of enhanced transportability.

8. The combination as set forth in claim 1, said base structure including a framework having separable members for assembly with paving slabs into a substantially rigid unitary ballasted assembly, in combination with said paving slabs; said framework having a stub mast projecting upwardly therefrom to receive said mast in mounted relation thereon.

9. The combination as set forth in claim 8, said base structure frames work having a first longitudinal member, two separate side members, each said member including at least one underlying transverse plate, a unifying plate overlying said members, in bolted relation therewith, and closure members removably secured to the outer end of each said member, in use to constrain adjoining ones of said paving slabs in unitary, rigid relation with said framework.

10. The combination as set forth in claim 1, said base structure comprising a light-weight plastic container having a mast receptacle therein, to receive said mast in supported relation therewith, said container having access and capacity for the insertion of locally available ballast material therein.

* * * * *